US007320502B1

(12) United States Patent
McCloskey

(10) Patent No.: US 7,320,502 B1
(45) Date of Patent: Jan. 22, 2008

(54) KNEEL CHAIR

(76) Inventor: George B McCloskey, P.O. Box 243, Pipersville, PA (US) 18947

( * ) Notice: Subject to any disclaimer, the term of this patent is extended or adjusted under 35 U.S.C. 154(b) by 57 days.

(21) Appl. No.: 11/164,832

(22) Filed: Dec. 7, 2005

(51) Int. Cl.
*A47C 7/50* (2006.01)

(52) U.S. Cl. ..... 297/423.11; 297/DIG. 6

(58) Field of Classification Search ..... 297/423.11, 297/423.16, DIG. 6, 423.12, 423.13, 440.11, 297/423.1, 344.12, 344.18
See application file for complete search history.

(56) References Cited

U.S. PATENT DOCUMENTS

| | | | | |
|---|---|---|---|---|
| 3,742,526 | A | 7/1973 | Lillard | |
| 4,171,549 | A | 10/1979 | Morrell et al. | |
| 4,513,518 | A * | 4/1985 | Jalbert et al. | 36/44 |
| 4,518,203 | A | 5/1985 | White | |
| 4,603,444 | A | 8/1986 | Suits | |
| 4,712,833 | A * | 12/1987 | Swanson | 297/228.12 |
| 4,772,071 | A | 9/1988 | Richards | |
| 5,015,037 | A * | 5/1991 | Giblin et al. | 297/452.1 |
| 6,298,508 | B1 | 10/2001 | McCloskey | |
| 6,540,301 | B1 * | 4/2003 | Bottoms | 297/423.11 |
| 6,926,365 | B2 * | 8/2005 | Bottoms | 297/423.12 |
| 2006/0082206 | A1 * | 4/2006 | Travis | 297/423.11 |

* cited by examiner

*Primary Examiner*—Milton Nelson, Jr.

(57) ABSTRACT

A two-part cushioned chair comprising a knee cushion and a sling seat supports the occupant in a combined kneeling and sitting position. Both components are supported by a frame that includes a contoured top surface which holds the knee cushion. The cushion is angled downward in the front and is composed of multiple foam layers covered with canvas. Upwardly-extending side rails are adjustably secured to the sides of the frame and support the sling-type seat which in use is positioned behind the occupant's knees. The sling seat is attached to the outer sides of each side rail being secured by a dowel rod stop on one side and a releasable Velcro®-type attachment on the opposite side.

19 Claims, 2 Drawing Sheets

KNEEL CHAIR

FIELD OF THE INVENTION

The present invention relates to furniture for human use. More specifically, it relates to a type of chair that supports the occupant in a combined kneeling and partially sitting position.

BACKGROUND OF THE INVENTION AND PRIOR ART

Those who were born and labored into the computer age may have developed sore backs caused by hours of sitting or just because of poor posture. Also many people have back-related injuries. For those with bad lower back strains or a sensitive lower spine it may be painful to remain seated for even a short time. This is especially true in the most commonly experienced position, working before a computer desk or table. There is therefore a need to provide a chair in which the user can optimally work in a position to take the body weight pressure off the spine and buttocks. There is also a need for a chair with these body support characteristics which is adjustable, portable, and rugged.

The closest patent prior art of which the applicant is aware includes the following U.S. Patents: U.S. Pat. No. 4,772,071 issued to Richards entitled "Knee Pads"; U.S. Pat. No. 4,603,444 issued to Suits entitled "Convertible Furniture Apparatus"; U.S. Pat. No. 4,171,549 issued to Morrell et al. entitled "Cushion Ensemble And Method Of Arranging Cushions To Provide The Same"; U.S. Pat. No. 4,518,203 issued to White entitled "Convertible Cushion Furniture"; U.S. Pat. No. 3,742,526 issued to Lillard entitled "Combination Chair And Chaise Lounge"; and U.S. Pat. No. 6,298,508 issued to the Applicant entitled "Kneel Cushions."

However, none of these examples provide the simplicity and economical use of a chair constructed with only two independent support mechanisms which provide the user with an adjustable and comfortable kneeling/sitting position by supporting the back of the legs and the knees.

SUMMARY OF THE INVENTION

In order to meet the needs described above, a two part cushioned chair has been devised which supports the occupant in a combined kneeling and sitting position. This chair reduces the pressure on the spine and is constructed of two main components: a knee cushion and sling seat. Both components have a support frame and are portable and rugged. The base frame includes an angled and contoured top surface that supports the knee cushion which receives the knees of the occupant. The cushion is composed of multiple foam layers and a duck cloth canvas cover and is angled downward in the front so that the occupant's knees are supported at the lowest point on the cushion.

Upwardly extending side rails adjustably secured to the sides of the base frame provide a lateral boundary to the occupant's lower legs and support a fabric sling-type seat positioned behind the occupant's knees. The sling seat is attached to the side rails, wrapping over the top, passing down the outer sides of each side rail being secured to the side rails by a dowel rod stop on one side and a releasable Velcro®-type attachment on the opposite side.

In use, this construction may require the user to back into the seat from the front, however the seat may be released by pulling a strap handle and reattaching it from behind the occupant for easy entry from above. The chair further includes adjustments for leg thickness and length as well as the seating angle. As the occupant kneels onto the knee cushion, the feet dangle comfortably over the contoured back end of the cushion with the toes pointing toward the floor. The sling seat is designed to support some of the body weight and is positioned behind the knees up to a point near or at the buttocks. Because the sling seat is composed of canvas surrounding a layer of microcell foam it provides contouring for extra comfort. The kneel chair of the present invention is adjustable to provide support to specific parts of the occupant's body for optimal weight distribution.

More specifically, the applicant has devised a cushioned kneeler for supporting a human body in a combined kneeling and sitting position comprising two components, a kneel cushion mounted on a base and an adjustable sling-type fabric seat. The base has a contoured top and further includes opposing lateral side members which rotatably and slidably support upwardly extending, laterally opposing, side rails. A quick release suspension seat is supported on opposite sides by the side rails. A knee cushion is mounted on the top of the base whereby the occupant of the chair is supported in a combined kneeling and sitting position. The top of the base is preferably curved and downward sloping and this curved shape is likewise given to the kneel cushion which it supports. The kneel cushion is constructed of multiple layers of cushioning material comprised of at least three layers of foam and one top layer of microcell foam rubber, all of which are encased in a pillow cover of duck cloth canvas. The seat is primarily composed of canvas fabric which includes a small pillow portion filled with a foam cushion material. The seat is downward sloping at an angle which is adjustable with respect to the base by height adjustment means affixed to the base which abuts the bottom edges of the side rails that support the seat. The seat is attached to the side rails on one side through an aperture in a first side rail by interference means located on an interior side of one of the side rails which prevents a side edge of the seat from moving outwardly through a slot in that rail. The other side of the seat is secured to the other side rail by hook and loop attachment means and the handle is provided for quickly and easily pulling the seat apart from the rail on that side. The top edges of both side rails include latch attachment means for further securing the seat. The base of the kneeler may include support wheels to provide easy rolling movement of the kneeler and optional screw type floor leveler feet may also be employed.

It is therefore the main object of the present invention to create a cushioned body support chair which is portable and supports a human body in a way to reduce pressure on the spine and buttocks. It is a further object of the present invention to create a cushioned chair which is durable and comfortable. Further advantages of the present invention will become readily apparent to those of skill in the art from the following drawings and description of the preferred embodiment.

DESCRIPTION OF THE PREFERRED EMBODIMENT

Figure 1:
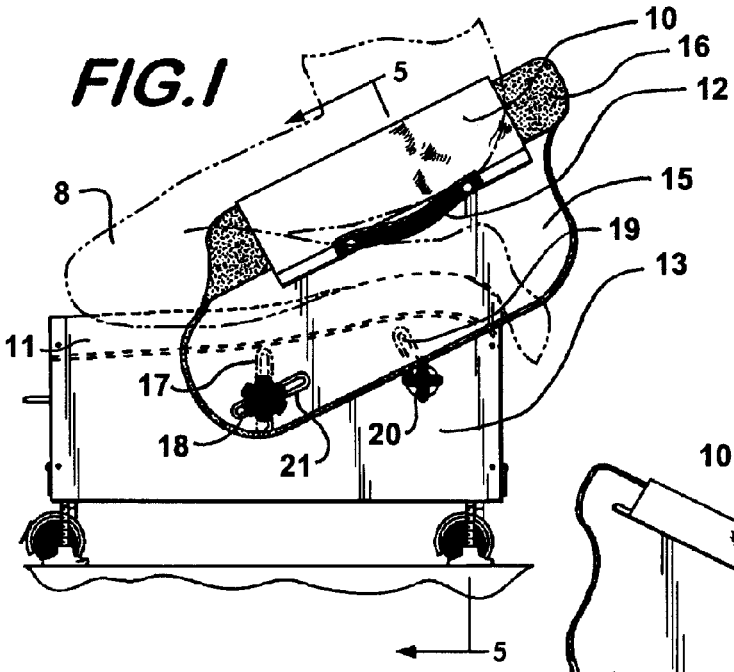
FIG. 1 is a right side elevation view with the occupant shown in phantom.

Referring now to FIG. 1, an occupant 8 is shown seated on the chair of the present invention which comprises a seat 10 having a cloth surface and a base 13. The occupant kneels onto the knee cushion 11 which is positioned on the base 13. The seat 10 is a sling-type seat which is angled downward, distributing the weight of the occupant from directly beneath the buttocks and behind the upper leg to the front of the lower leg and shins onto the knee cushion 11. The knee cushion supports most of the weight of the occupant and it extends below the occupant's knees across substantially the entire length of the lower legs or shins. A handle 12 is attached to the sling seat 10 so that when pulled it quickly releases the seat from the side rail. The seat is attached to the upper section of side rail 15 which consists of a broad area of Velcro®-type latch material 16 that extends from the sides and over the top of side rail 15 on one side and similarly over a corresponding side rail on the opposite side. A cooperating Velcro®-type hook material panel is attached (not shown) to the underside of the sling seat 10.

The angle of the seat 10 is adjustable. A higher angle of the seat positions the occupant so that his/her weight is distributed more to the knees and ankles on cushion 11 thereby relieving compressive forces from the seat 10 against the spine and buttocks. Adjustability is provided by releasable screw knobs 18 and 20 and their cooperative clamp assemblies with slots 17 and 19 in the base and a slot 21 at the front of the side rail to clamp the side rail at a selected position. Mirror image slots and releasable clamp screws with like numbers for uniformity of illustration are utilized on the opposite side of the kneel chair as shown in FIG. 2.

Figure 2:
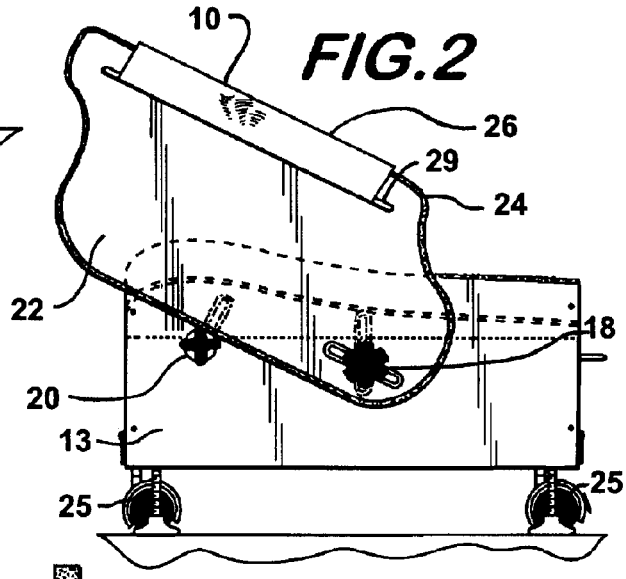
FIG. 2 is a left side elevation view.

Referring now to FIG. 2, the left side of the invention opposite FIG. 1 is shown. Sling seat 10 includes a portion 26 which extends over the top of the left side rail, passing through slot 29, being secured on the inside of the side rail 22 by an interference fit created by a removable dowel interior to the left side rail as more clearly shown in FIG. 5. The seat is further secured to the right side rail by Velcro®-type latch material 24 which joins with Velcro®-type hook material on the underside of the seat. A minor seat position adjustment can be made by sliding the sling seat along slot 29. Base 13 includes lockable wheels 25 that provide rolling support for the chair.

Figure 3:
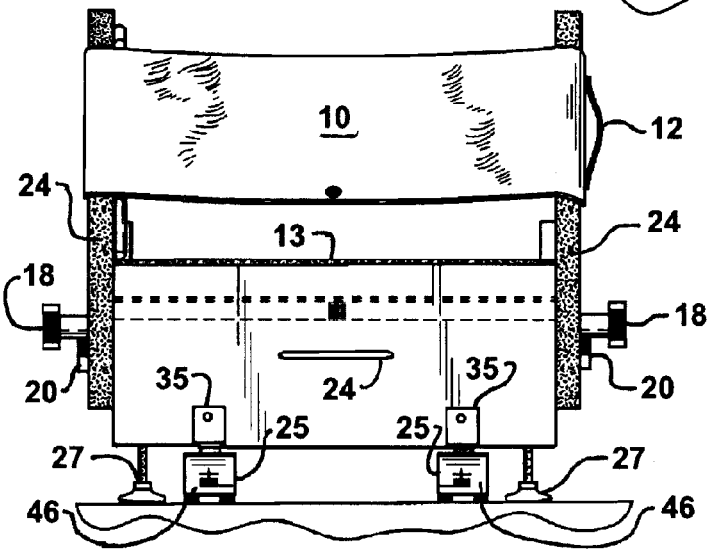
FIG. 3 is a front elevation view.

Referring now to FIG. 3, Velcro®-type latch material 24 is secured to the top surfaces of the side rails. This loop attachment to the hook material on the underside of the sling seat 10 helps stabilize the seat which is composed of a duck cloth cover over a layer of microcell foam. This frontal view shows a pull handle 24 on the front of the base and the attachment means 35 for castor wheels 25 that include a locking latches 46. Adjustable screw-type feet 27 are also shown. The feet 27 are located at each of the four corners of the base 13 and may be employed to further adjust the angle of the kneeling position or prevent rolling movement. The curved top of the base 13 is preferably composed of flexible plywood of at least ¼" thick. The side rails and base frame are preferably constructed of ¾" thermofused laminated particle board.

Figure 4:
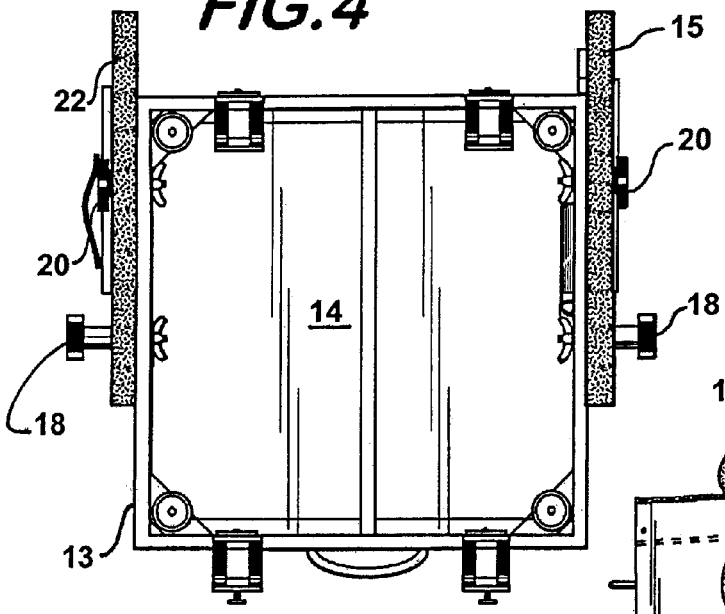
FIG. 4 is a bottom plan view.

Referring now to FIG. 4, a bottom view of the kneel chair is shown. Screw clamp knobs 18 and 20 loosen and tighten their respective clamp assemblies. These knobs are affixed to threaded bolts which when tightened provide a clamping effect that holds the side rails tightly against side surfaces of the base to secure the seat in a selected position. From this view the underside of the top 14 of the base 13 can be seen. The top 14 is curved as shown in the previous figures to provide an optimal support surface shape for the kneel cushion.

Figure 5:
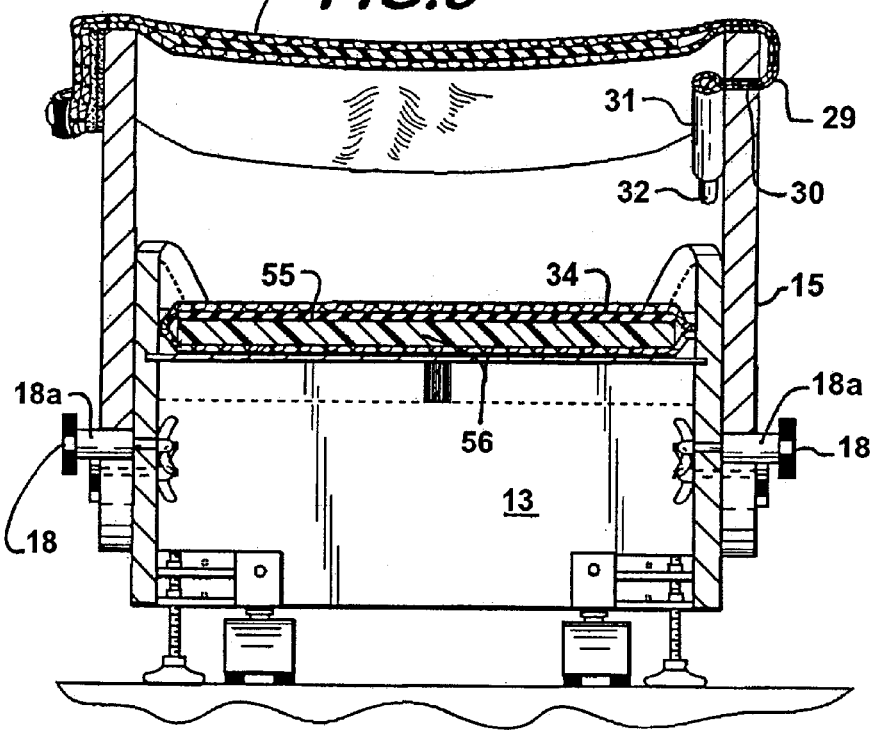
FIG. 5 is a rear sectional view taken from FIG. 1 as shown in that figure.

Referring now to FIG. 5, one aspect of the present invention is the utilization of multiple layers of the kneeling cushioning materials of different densities shown as layers 55 and 56. The preferred embodiment includes a top layer 55 of 2 lb/ft3 of microcell or neoprene rubber. The remainder of the cushion comprises five to seven layers of ¼" thickness of firm small, air bubble foam 56. The air bubble foam 56 is less dense relative to the top layer that is somewhat firmer but not too soft that allows pushing against the front of the knee caps. Due to the thickness and density of these layers, the occupant's legs sink into the cushions thus reducing the pressure on the shins and knees with little or no knee cap pressure. Yet greater kneeling comfort is achieved by enclosing these layers within a 10 oz duck cloth canvas cover 34. This material provides a strong, non-stretch, non-skid surface 34 whose characteristics provide a unique comfort and support to the occupant which is further enhanced by the contoured shape of the kneel cushion. Additional cushioning is provided by the slight flexure of base 13 because it comprises a ¼" of flexible plywood layers suspended on the base framework 13.

With continued reference to FIG. 5, the through-slot attachment of the sling seat on the left side of the kneel chair is shown. The end portion of material 29 on the left side of the seat 10 passes through a slot 30 in the left side rail 15. Interior to the side rail is loop 31 along the side edge of the seat material. Fitted within the loop is a dowel 32 which stops the material of the seat from pulling through the slot when a tensile force is applied. When it is desired to remove the seat from the kneel chair, the dowel or rod is removed and the loop can then collapse to pass through the slot. On the opposite side of the seat, Velcro®-type attachment means provides a more quickly releasable attachment to facilitate entry and exit of the chair. This figure also shows greater detail of the clamp assemblies which include clamp knobs 18 on either side of the chair with their associated bolts, wing nuts, and necessary washers. Knobs 18 include an axially extending hollow shank 18*a* which provides a pressure bearing surface against the interior side walls of the side rail slots.

Figure 6:
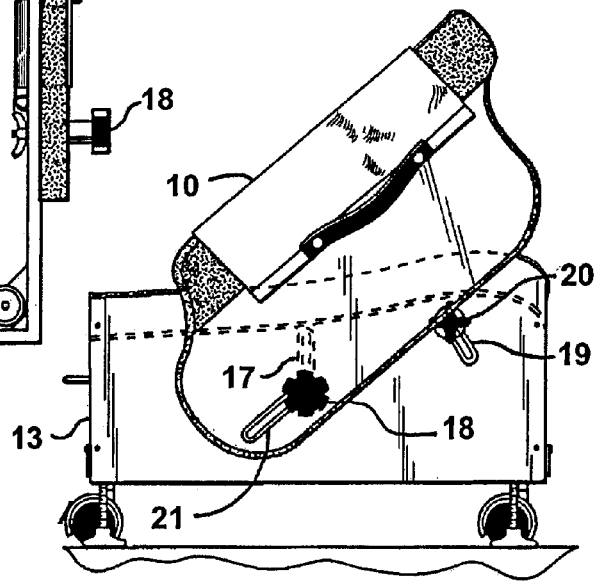
FIG. 6 is a right side elevation view showing an alternate position of the seat structure.

As shown in FIG. 6, the seat may be moved to this extreme position to accommodate the size and length of the occupant's legs. This is done by turning the screw knobs to loosen their clamping effect and then by re-tightening the knobs once the seat side rails have been moved to their desired position. When loosened, knob 18 and its associated bolt moves vertically along slot 17 in the side of base 13, with freedom of movement also in slot 21 of the seat side rail for leg length adjustment. This also allows the occupant to determine how much of the sling seat 10 is desired to support the buttocks. In addition, the angle of the seat may be raised as high as the position shown in this figure by releasing angle adjustment knob 20 which then moves in slot 19 of the base and then re-tightens it. Angle adjustment knob 20 provides a stop support against the bottom edge of the side rail which is otherwise rotatable about forward positioning knob shaft 18. It should be understood that like adjustment mechanisms on the opposite side of the kneel chair will be likewise adjusted to provide symmetry of alignment of the seat.

From the foregoing figures of drawing and description of the preferred embodiment, it will be appreciated that the objects of the invention have been achieved. When using the kneel chair, the body weight is shifted to the shins and more to the knees by a slightly forward tilt of the base. The kneel chair has adjustments for leg length, leg thickness, and weight distribution. The present invention is particularly suited to people who spend a great deal of time before a computer and for those who have weak backs or sore buttocks. It also affords a comfortable computer working position and a pleasant change in the work environment because of a sensation of partial weightlessness. In addition, this device may strengthen the leg muscles as the legs are in a kneeling position which uses other muscles normally relaxed.

It should be understood that there may be other modifications and changes to the present invention that will be obvious to those of skill in the art from the foregoing description, however, the present invention should be limited only by the following claims and their legal equivalents.

What is claimed is:

1. A kneeler for supporting a human occupant in a combined kneeling and sitting position, comprising:

a base having a top and opposing lateral side members;

upwardly extending, laterally opposing side rails each affixed to a said side member of said base, wherein said side rails are slidably and rotatably affixed to the base;

a quick-release suspension seat supported on opposite sides by attachment to said side rails; and a knee cushion mounted on said top of said base whereby the occupant of said kneeler is supported in a combined kneeling and sitting position.

2. The kneeler of claim 1 wherein said top of said base is curved.

3. The kneeler of claim 1 wherein said top of said base is downward sloping.

4. The kneeler of claim 1 further including extendable feet affixed to the bottom of said base for adjustable support thereof.

5. The kneeler of claim 1 wherein attachment means of said seat comprise hook and loop fasteners for releasably affixing said seat to said side rails.

6. The kneeler of claim 1 wherein said side rails are secured to said base by nut and bolt clamping means.

7. The kneeler of claim 6 wherein said side rails are movable with respect to said clamping means by slots in said side rails through which said clamping means pass.

8. The kneeler of claim 1 wherein the seat is downward sloping at an angle which is adjustable with respect to said base by height adjustment means affixed to said base which abut the bottom edges of said side rails.

9. The kneeler of claim 1 wherein said seat is constructed of a cushion material covered by cloth.

10. The kneeler of claim 9 wherein said cloth is duck cloth canvas.

11. The kneeler of claim 1 wherein said knee cushion is comprised of multiple layers of cushioning material encased in a cloth cover.

12. The kneeler of claim 11 wherein said layers comprise at least three layers of microcell foam.

13. The kneeler of claim 11 wherein one of said layers is neoprene rubber or microcell foam.

14. A kneeler for supporting a human occupant in a combined kneeling and sitting position, comprising:

a base having a top and opposing lateral side members;

upwardly extending, laterally opposing side rails each affixed to a said side member of said base;

a quick-release suspension seat supported on opposite sides by attachment to said side rails;

a knee cushion mounted on said top of said base whereby the occupant of said kneeler is supported in a combined kneeling and sitting position; and wherein said seat is attached on one side through an aperture in a first said side rail by interference means located on an interior side of said first side rail which prevents a side edge on said one side of the seat from moving outwardly through said aperture.

15. The kneeler of claim 14 wherein said interference means comprises a rod fitted into a collapsible loop at said seat side edge.

16. A kneeler for supporting a human occupant in a combined kneeling and sitting position, comprising:

a base having a top and opposing lateral side members;

upwardly extending, laterally opposing side rails each affixed to a said side member of said base;

a quick-release suspension seat supported on opposite sides by attachment to said side rails;

a knee cushion mounted on said top of said base whereby the occupant of said kneeler is supported in a combined kneeling and sitting position; and wherein a said side of said seat includes a handle for pulling said seat apart at hook and loop attachment means which secures another said side of said seat to a second side rail.

17. The kneeler of claim 16 further including wheels affixed to the bottom of said base for rolling support of said kneeler.

18. A kneeler for supporting a human occupant in a combined kneeling and sitting position, comprising:

a base having a top and opposing lateral side members;

upwardly extending, laterally opposing side rails each affixed to a said side member of said base;

a flaccid sling seat supported only on opposite ends by attachment to said side rails; and a knee cushion mounted on said top of said base whereby the occupant of said chair is supported in a combined kneeling and sitting position.

19. The kneeler of claim 18 wherein said seat is attached on one side through an aperture in a first side rail by interference means located on an interior side of said first side rail which prevents a side edge on said one side of the seat from moving outwardly through said aperture.

* * * * *